United States Patent [19]

Green et al.

[11] 4,310,291

[45] Jan. 12, 1982

[54] LIQUID FUEL PUMPING APPARATUS

[75] Inventors: Alan C. Green, Reading; Stephen D. Gregory, Kingsbury, both of England

[73] Assignee: Lucas Industries Limited, Birmingham, England

[21] Appl. No.: 56,114

[22] Filed: Jul. 9, 1979

[30] Foreign Application Priority Data

Aug. 3, 1978 [GB] United Kingdom ..... 32075/78

[51] Int. Cl.[3] ..... F02M 59/08

[52] U.S. Cl. ..... 417/435; 417/462; 417/286; 123/179 L

[58] Field of Search ..... 123/179 L, 366, 516; 417/462, 435, 428, 286

[56] References Cited

U.S. PATENT DOCUMENTS

| | | | |
|---|---|---|---|
| 814,883 | 3/1906 | Starr | 417/435 |
| 3,307,491 | 3/1967 | Wolff | 417/435 |
| 4,083,345 | 4/1978 | Davis | 123/366 |

*Primary Examiner*—Charles J. Myhre
*Assistant Examiner*—Carl Stuart Miller

[57] ABSTRACT

A liquid fuel pumping apparatus includes a plunger and a piston which together are moved inwardly by cam means to deliver excess fuel for starting an engine, the plunger only being effective to supply fuel to the engine when the latter has attained a predetermined speed. The piston constitutes a valve to permit fuel and any air contained within the cylinder to escape from the cylinder during the initial inward movement of the piston.

5 Claims, 7 Drawing Figures

LIQUID FUEL PUMPING APPARATUS

This invention relates to liquid fuel pumping apparatus for supplying fuel to a compression ignition engine and of the kind comprising an injection pump including a reciprocable plunger contained within a bore and cam means for imparting inward movement to the plunger to effect fuel delivery through an outlet or a plurality of outlets in turn, a feed pump which draws fuel from a fuel inlet and supplies fuel to the injection pump during the filling periods thereof, means for controlling the amount of fuel supplied to the bore during a filling period whereby the amount of fuel delivered to the engine is determined by said means, a cylinder forming part of the injection pump, a reciprocable piston within said cylinder, valve means responsive to the output pressure of the feed pump and arranged when the pressure is below a set value to connect said cylinder and said bore so that the plunger and piston together effect delivery of fuel to the engine, said valve means when the output pressure of the feed pump is above said set value disconnecting the cylinder from the bore so that the plunger alone effects delivery of fuel to the engine, the plunger and piston together acting to supply excess of fuel to the engine for the purpose of starting the engine.

As is well known in the art it is important with the type of apparatus described to prevent so far as is possible, air entering the pumping apparatus through the fuel inlet. This is because when air is present in the various passages, bores and cylinders of the injection pump it can prevent fuel being supplied by the apparatus or at least upset the operation of the apparatus. In some situations it may be impossible to prevent air entering the injection pump such for example when the fuel tank from which the apparatus is supplied with fuel is allowed to empty. When the fuel tank is refilled with fuel it is first of all necessary to purge the air from the low pressure portion of the fuel circuit i.e. the feed pump and associated pipes and then to bleed air from the high pressure portion of the circuit i.e. the injection pump. Purging the air from the low pressure portion of the circuit forms no part of the present invention. Bleeding the air from the high pressure portion of the circuit has in the past been achieved by causing the injection pump to act as a low pressure pump by disconnecting one or more of the outlets from the remaining portion of the engine fuel system and then cranking the engine until substantially air free fuel flows through the disconnected outlets. In another arrangement a special vent valve is opened and again the engine cranked until the air is bled from the injection pump. These two methods of bleeding the air are inconvenient because they do assume a knowledge of the fuel system and also they do involve a loss of fuel generally to the exterior of the apparatus.

The object of the present invention is to provide an apparatus of the kind specified in a simple and convenient form.

According to the invention, in an apparatus of the kind specified said piston constitutes a valve at one extreme of movement to allow air contained within the cylinder to be vented from the cylinder.

One example of a fuel injection pumping apparatus in accordance with the invention will now be described with reference to the accompanying drawings.

Figure 1:
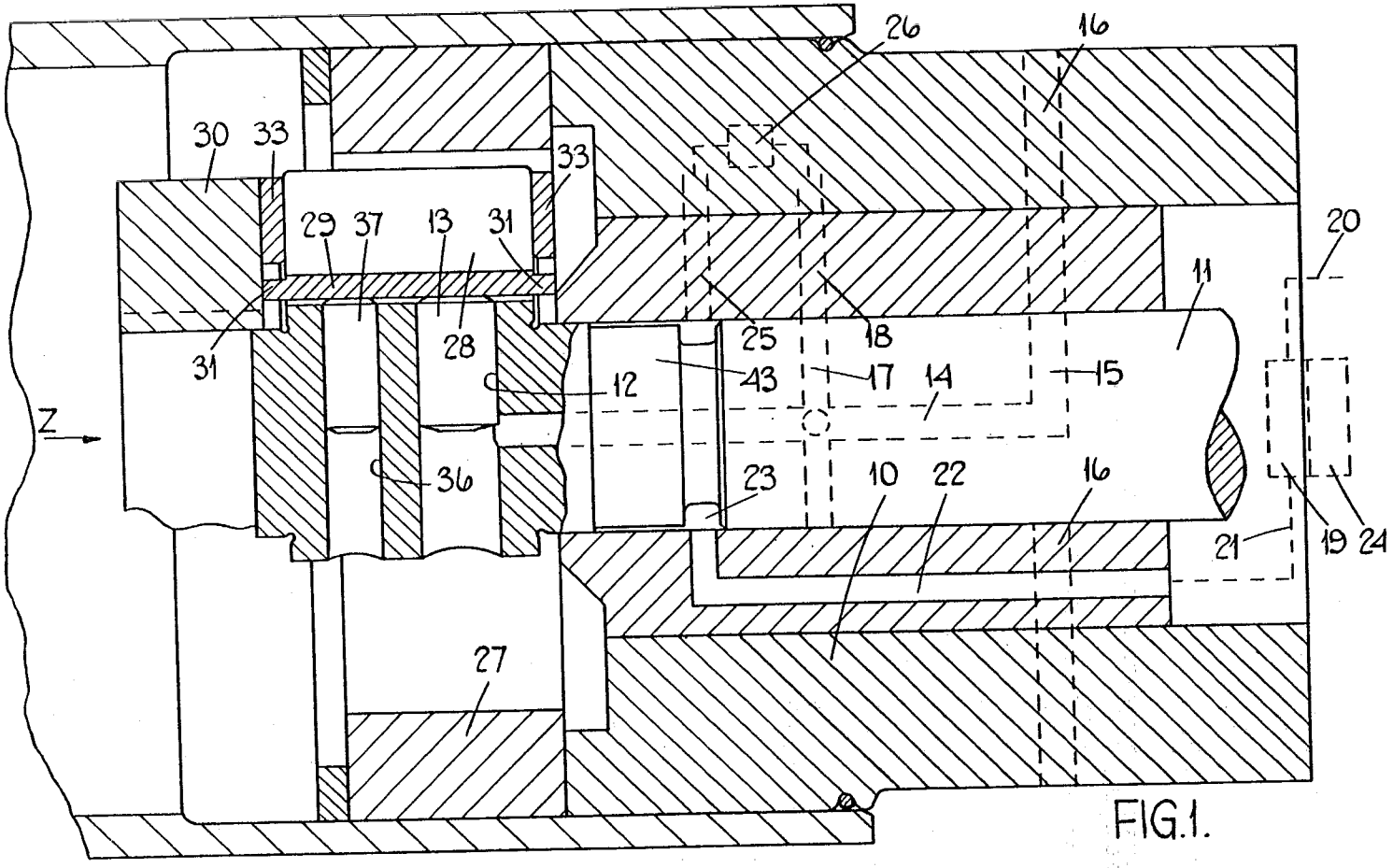
FIG. 1 is a part sectional side elevation of a known apparatus.

With reference to the drawings, the apparatus comprises a body part 10 in which is mounted a rotary cylindrical distributor member 11. At one end the distributor member is coupled to a drive shaft not shown which in use is adapted to be driven by an associated engine in timed relationship therewith. Moreover, formed in the distributor member is a transversely extending bore 12 in which is mounted a pair of pumping plungers 13 only one of which is shown.

Extending within the distributor member and communicating with the bore intermediate the ends thereof, is a passage 14 which communicates with a radially disposed delivery passage 15 the latter being positioned to register in turn with a plurality of outlet ports 16 which in use, are connected to injection nozzles respectively of the associated engine. The passage 14 also communicates with radially disposed inlet passages 17 and these can communicate in turn with an inlet port 18 which is formed in the body part 10. The apparatus includes a feed pump 19 which is shown in dotted outline but which incorporates in a well known manner, a rotary part which is mounted upon the distributor member 11. The feed pump has an inlet 20 for connection to a source of fuel and an outlet 21 which communicates with a passage 22 formed in the body part and communicating with a groove 23 formed in the periphery of the distributor member. Associated with the feed pump 19 is a valve 24 the purpose of which is to ensure that the outlet pressure of the feed pump varies in accordance with the speed at which the apparatus is driven. The groove 23 effects connection between the passage 22 and a further passage 25 formed in the body part and which is connected to the port 18 by way of a fuel control device 26. The device 26 is shown in the drawing in block form but it may comprise of a simple adjustable throttle whereby the amount of fuel which can flow through the port 18 when it is in register with the passage 17 can be controlled. Alternatively the device 26 may include more sophisticated arrangements for controlling precisely the amount of fuel which is delivered through the port 18.

Mounted within the body part 10 is an annular cam 27 on the internal peripheral surface of which are formed cam lobes. Conveniently, the cam ring is angularly adjustable within the body part. For engagement with the cam lobes there is provided a pair of rollers 28 only one of these being illustrated. The rollers are carried by shoes 29 and these are located within radially disposed slots formed in the distributor member. The bore 12 opens into the base walls of the slots.

In operation the cam lobes are so disposed that when the port 18 is in register with the passage 17 fuel is supplied to the bore 12 and the plungers 13 move outwardly by an amount determined by the device 26. As the distributor member continues to rotate, the passage 17 is moved out of register with the port 18 and the passage 15 is moved into register with a port 16. Furthermore, inward movement is imparted to the plungers by the interaction of the rollers 28 with the cam lobes. The amount of fuel supplied through the particular outlet to the engine is the same as that which is supplied to the bore by way of the device 26.

Figure 2:
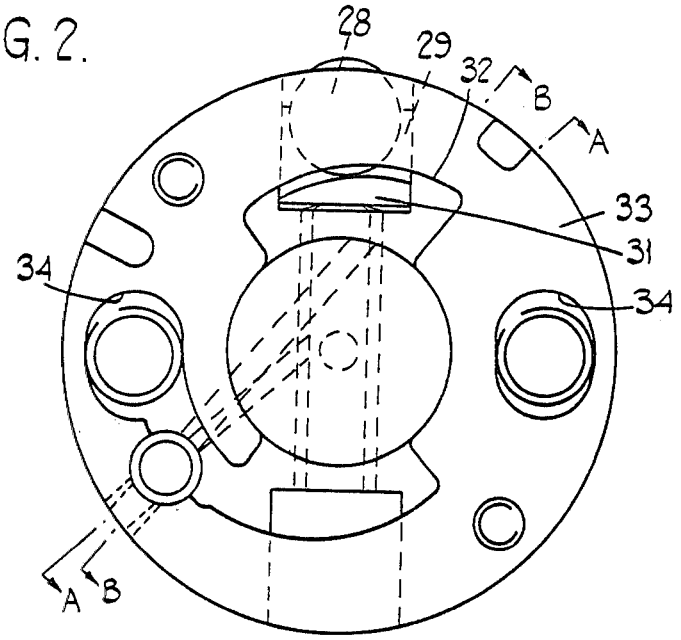
FIG. 2 is a view in the direction of the arrow Z of FIG. 1 with parts removed for the sake of clarity.
Figure 3:
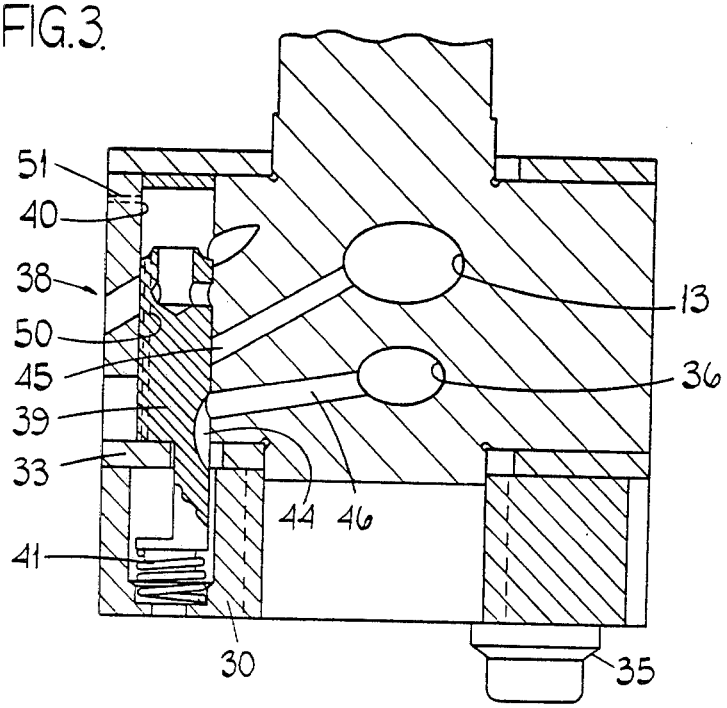
FIG. 3 is a section along the line A—A of FIG. 2.

It is important to limit the maximum quantity of fuel which may be supplied to the engine under normal operating conditions and for this purpose the extent of outward movement of the plungers 13 is limited by controlling the outward movement of the shoes 29. As will be seen in FIG. 1, the shoes have extensions 31 at their opposite ends and as shown in FIG. 2, the extensions 31 have a curved outer surface for engagement with a complementary surface 32 formed on a ring member 33 which surrounds the distributor member. The surfaces on the extensions 31 and the surfaces 32 are not of constant radius so that angular adjustment of the members 33 will effect an adjustment in the amount of outward movement permitted to the shoes 29 and therefore the plungers. One of the members 33 is of plate like form and is provided with a pair of elongated apertures 34 through which extend securing bolts 35 which are seen in FIG. 3. The bolts 35 serve to secure a ring member 30 to the distributor member at the same time gripping the plate member 33 to prevent angular movement thereof once adjustment has taken place. The ring member 33 is internally splined for connection to the aforesaid drive shaft. The other ring 33 is positioned for engagement by the extensions 31 at the other ends of the shoes 29 and the further ring may be coupled to the first mentioned ring so as to move angularly therewith during the adjusting process.

With the arrangement so far described irrespective of the setting of the device 26 the amount of fuel which can be supplied to the engine will be limited by the permitted movement of the plungers 13.

When starting an engine and particularly when the engine is cold, it is necessary to provide an additional quantity of fuel and with the arrangement so far described this can only be achieved by adjusting the rings 33. In order to overcome this problem a transversely extending cylinder 36 is formed in the distributor member and accommodates a pair of pistons 37. As will be noted from FIG. 1 the diameter of the pistons 37 is less than that of the diameter of the plungers 13 and conveniently the bore 12 and cylinder 36 are aligned so that the plungers and pistons engage with the same pair of shoes 29. When the bore 12 is in communication with the cylinder 36, an additional quantity of fuel can be supplied by the apparatus because the pistons 37 will operate in the same manner as the plungers 13. It is necessary to ensure, however, that the additional quantity of fuel is supplied to the engine for no longer than is necessary and for this purpose a valve is provided which establishes or breaks the communication between the bore and cylinder.

Figure 4:
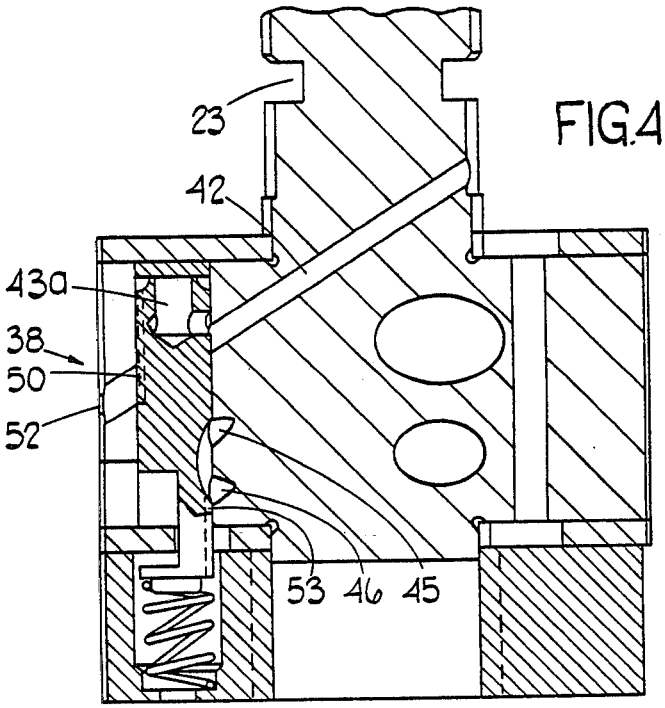
FIG. 4 is a section along the line B—B of FIG. 2 showing parts of the apparatus in an alternative position.

The valve is seen at 38 in FIGS. 3 and 4 and it comprises a valve member 39 which is accommodated within a bore formed in the distributor member and extending substantially parallel to the rotary axis thereof. The valve member 39 is biassed towards the position in which the bore 12 and cylinder 36 are in communication with each other the biasing being effected by means of a coiled compression spring 41. The spring 41 is accommodated within an extended portion of the bore defined in the member 30. At its opposite ends, the valve member 39 is subjected to the pressure of fuel delivered by the feed pump and this supply of fuel is conveyed to the bore 40 by means of a passage 42 which is formed in the distributor member and which communicates with a slightly reduced portion 43 of the distributor member adjacent the groove 23 so that the passage 42 is effectively in communication with the outlet 21 of the feed pump. Because of the space available it is necessary to provide a passage **43*a* within the valve member so that the fuel pressure within the passage 42 can act on the end of the valve member 39 when the latter has been moved its maximum extent as seen in FIG. 4, by the spring 41. The valve member 39 is provided with a longitudinal groove 44 the purpose of which when the valve member is in the position shown in FIG. 4, is to place the passages 45 and 46 communicating with the bore 12 and cylinder 36 respectively in communication with each other. When the valve member is moved to the alternative position as seen in FIG. 3, then the passage 45 is closed and the passage 46 is placed in communication by way of the groove 44**, with a drain conveniently the space within the housing and which communicates with the inlet of the feed pump or with a drain pipe extending to the fuel tank.

When the engine is at rest the output pressure of the feed pump will be zero and therefore the valve member 39 will assume the position shown in FIG. 4 under the action of the spring 41. In this position the two passages 45 and 46 are in communication with each other so that when an attempt is made to start the engine both the plungers 13 and pistons 37 will be effective to deliver fuel to the engine. When the engine starts and its speed of rotation increases to a set value, the output pressure of the feed pump will rise to a point at which the valve member 39 is moved against the action of spring 41 to the position shown in FIG. 3 and when this occurs the passages 45 and 46 are no longer in communication with each other so that the pistons 37 are no longer effective to supply fuel to the engine. The cylinder 36 which contains the pistons is placed in communication with a drain. The valve member 39 is provided with a differential action so that a higher pressure of fuel is required to effect the initial movement of the valve member than is required to maintain it in the position shown in FIG. 3. This is achieved by shaping the end of the valve member to define a seating so that only a portion of the valve member is initially subjected to the fuel pressure. The outer annular area of the valve member is vented to a drain by way of a restricted passage which may be formed in the valve member or it can be formed in the wall of the bore 40. The passage in the valve member is shown at 50 in FIG. 3 and the passage in the wall of the bore is shown at 51 in FIG. 3. Such an arrangement would give rise to a continuous loss of fuel from the outlet of the feed pump. This loss of fuel however can be avoided by arranging that the passage is closed after the valve member has started to move. FIG. 4 shows the passage 50 communicating with a port on the periphery of the valve member and which communicates with a drain port 52. Once the valve member has moved the two ports are moved out of register so that the loss of fuel from the outlet of the feed pump does not take place.

The additional fuel will be supplied each time the engine is started and the fact that the pistons 37 are effective to supply fuel to the associated engine each time the engine is started, is utilised as will be described, to purge air from the injection pump.

Figure 5:
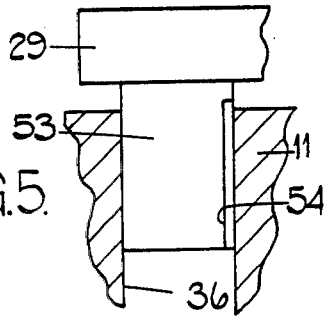
FIGS. 5, 6 and 7 show modifications of a portion of the apparatus as seen in FIG. 1.

Turning now to FIG. 5 a modified pumping piston 53 is located in the cylinder 36. Both the pumping pistons therein may be modified as will be described, or the modification may only be applied to one piston.

As seen in FIG. 5, the piston 53 is provided with an axially extending groove 54 in its peripheral surface. The groove 54 extends from the inner end of the piston to adjacent the outer end and in use, the groove will be covered by the wall of the cylinder as the piston 53 is moved inwardly. As a result during the initial inward movement of the piston 53 fuel together with air contained in the cylinder will be forced along the groove 54 and will spill into the space defined within the housing. As soon as the groove is covered this flow of fuel and air will cease and if sufficient of the air within the cylinder has been displaced, a flow of fuel will take place to the associated engine in the manner described. It may well be, however, that several strokes of the piston are required to displace sufficient of the air to ensure delivery of fuel. It will be appreciated that the spillage of fuel and air as has been described, will only take place whilst the engine speed is below the value at which the aforesaid valve member moves to break the communication between the cylinder 36 and the bore 12. During the time the communication is established, however, it is hoped that sufficient of the air will be purged to enable the injection pump to operate normally. In any event, if the injection pump contains a large quantity of air the engine will not start and the purging action will continue as the engine is cranked, until fuel is delivered by the injection pump.

Figure 6:
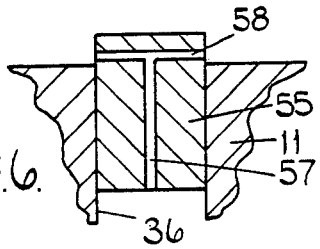

In FIG. 6 there is shown a further modification of the pumping piston in this case referenced 55. In this example an axial passage 57 is formed in the piston and which extends from the inner end thereof to adjacent the outer end. The axial passage communicates with a cross passage 58 the ends of which after a predetermined inward movement of the piston, will be covered by the wall of the cylinder.

Figure 7:
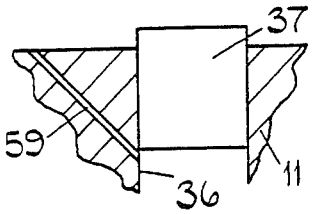

A further modified arrangement is shown in FIG. 7 and here the piston is exactly as described with reference to FIGS. 1–4 inclusive. In this case, however, a spill passage 59 is formed in the distributor member the outer end of the passage communicating with the space defined in the housing whilst the inner end of the passage communicates with the cylinder 36 at a position to be covered by the piston shortly after it has started its inward movement.

It will be appreciated that when the modified pistons are used it may be necessary to increase slightly the displacement of the pistons to compensate for the loss of fuel during the initial inward movement of the pistons.

We claim:

1. A liquid fuel pumping apparatus for supplying fuel to a compression ignition engine and of the kind comprising an injection pump including a reciprocal plunger contained within a bore and cam means for imparting inward movement to the plunger to effect fuel delivery through an outlet or a plurality of outlets in turn, a feed pump which draws fuel from a fuel inlet and supplies fuel to the injection pump during the filling periods thereof, means for controlling the amount of fuel supplied to the bore during a filling period whereby the amount of fuel delivered to the engine is determined by said means, a cylinder forming part of the injection pump, a reciprocal piston within said cylinder, valve means responsive to the output pressure of the feed pump and arranged when the pressure is below a set value to connect said cylinder and said bore so that the plunger and piston together effect delivery of fuel to the engine, said valve means when the output pressure of the feed pump is above said set value disconnecting the cylinder from the bore so that the plunger alone effects delivery of fuel to the engine, the plunger and piston together acting to supply excess of fuel to the engine for the purpose of starting the engine, characterized in that said piston constitutes a valve at one extreme of its movement to allow air contained within the cylinder to be vented from the cylinder.

2. An apparatus according to claim 1 characterized by passage means communicating with said cylinder, said piston at its outer extreme of movement allowing flow of fuel through said passage means as the piston is moved inwardly, the piston after a predetermined inward movement preventing further flow through said passage means.

3. An apparatus according to claim 2 in which said passage means comprises a groove formed in the wall of the piston and extending from the inner end to adjacent the outer end thereof.

4. An apparatus according to claim 2 in which said passage means comprises a passage formed in the piston and extending from the inner end thereof and breaking out onto the periphery of the portion at a position to be covered by the wall of the cylinder after a predetermined inward movement of the piston has taken place.

5. An apparatus according to claim 2 in which said passage means comprises a passage communicating with said cylinder at a position to be covered by the inner end of the piston after a predetermined inward movement of the piston.

* * * * *